US005932169A

United States Patent [19]

Strelbisky

[11] Patent Number: 5,932,169

[45] Date of Patent: Aug. 3, 1999

[54] REMOVAL OF SLAG AND/OR STEEL BUILD-UP FROM LANCES

[75] Inventor: Michael J. Strelbisky, Burlington, Canada

[73] Assignee: A.H. Tallman Bronze Co, Ltd., Burlington, Canada

[21] Appl. No.: 09/044,878

[22] Filed: Mar. 20, 1998

Related U.S. Application Data

[60] Provisional application No. 60/041,196, Mar. 25, 1997.

[51] Int. Cl.[6] ..... C21B 7/16

[52] U.S. Cl. ..... 266/47; 266/135; 266/270; 266/DIG. 1

[58] Field of Search ..... 266/47, 44, 135, 266/136, 268, 270, DIG. 1

[56] References Cited

U.S. PATENT DOCUMENTS

| | | | |
|---|---|---|---|
| 3,575,706 | 4/1971 | Ummel | 266/135 |
| 5,152,952 | 10/1992 | Brenczek et al. | 266/136 |
| 5,517,950 | 5/1996 | Kendrick | 266/136 |

*Primary Examiner*—Scott Kastler
*Attorney, Agent, or Firm*—Rogers & Scott

[57] ABSTRACT

A method of removing slag and/or steel build-up from lances in steel making furnaces includes blasting dry ice (solid $CO_2$) pellets on to a hot lance as it is being drawn out of a furnace. A refractory or ceramic coating may be applied to the lance while it is being inserted into the furnace.

14 Claims, 2 Drawing Sheets

REMOVAL OF SLAG AND/OR STEEL BUILD-UP FROM LANCES

RELATED APPLICATION

This invention claims priority from U.S. provisional patent application No. 60/041,196 filed Mar. 25, 1997.

FIELD OF INVENTION

This invention relates to the removal of slag and/or steel build-up from lances in steel making furnaces, such as basic oxygen furnaces, in which a lance is used to supply oxygen to the furnace.

BACKGROUND OF INVENTION

Although various attempts have been made in the past to provide a method of removing slag and/or steel build-up from such lances, none of the prior attempts have been particularly successful, particularly since the 1980's when introduction of a new technique in which slag is splashed onto the walls of the furnace made the problem worse. U.S. Pat. No. 5,152,952 (Brenczek et al) issued Oct. 6, 1992 is an example of the prior art.

It is therefore an object of the invention to provide an improved method for removing slag and/or steel build-up from such lances.

STATEMENT OF INVENTION

According to the present invention, dry ice (solid $CO_2$) pellets are blasted onto a hot lance as it is being drawn out of a furnace. Also, a refractory or ceramic coating may be applied to the lance while it is being inserted into the furnace to minimize the build-up.

BRIEF DESCRIPTION OF THE DRAWINGS

Embodiments of the invention will now be described, by way of example, with reference to the accompanying drawings, in which.

DESCRIPTION OF PREFERRED EMBODIMENTS

Figure 1:
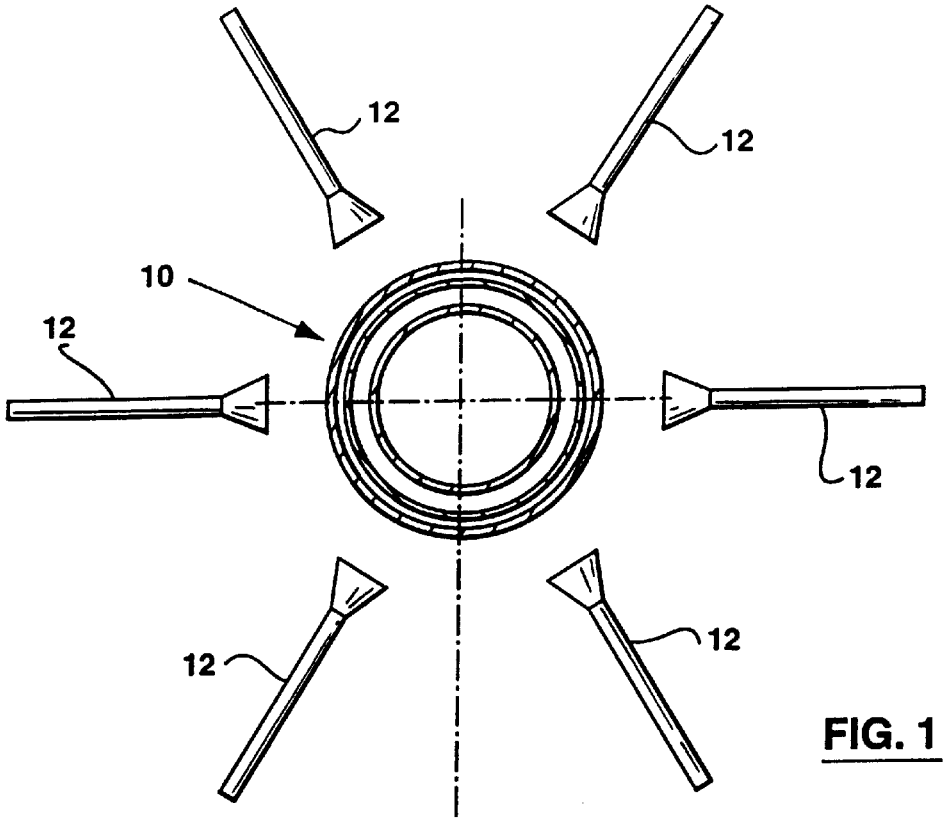
FIG. 1 is a diagrammatic plan view of an arrangement for blasting $CO_2$ pellets onto a lance in accordance with one embodiment.
Figure 2:
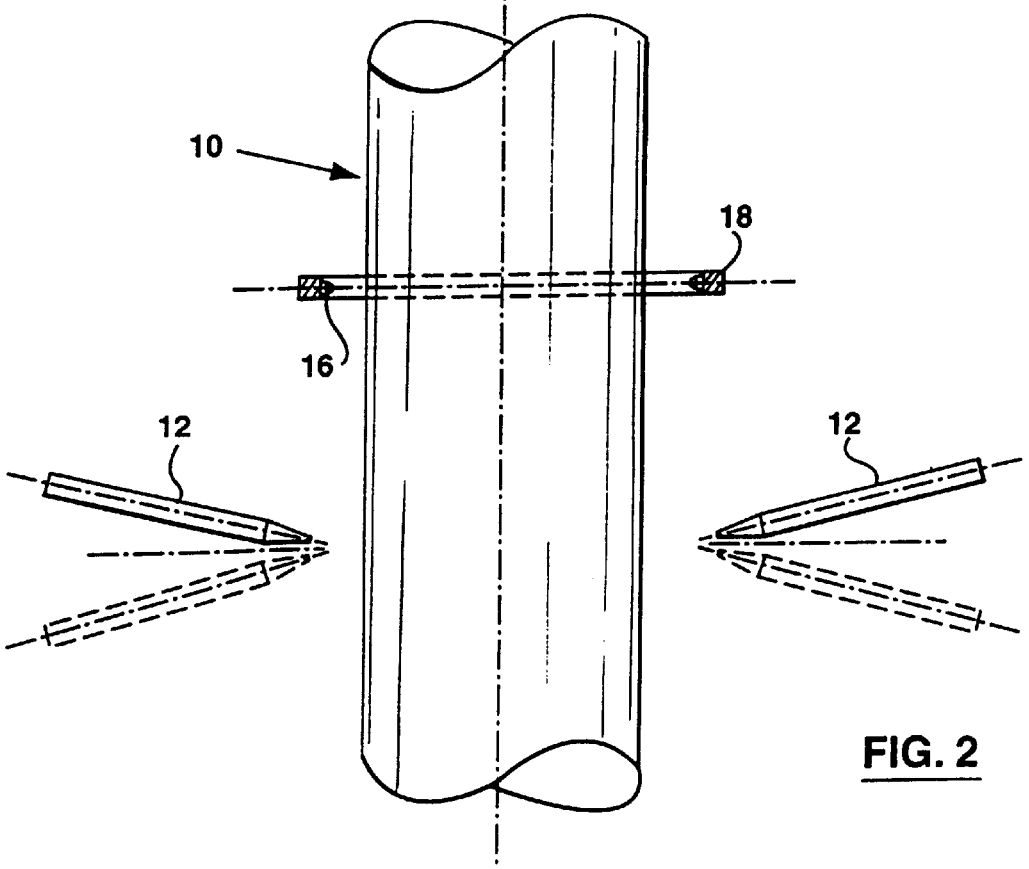
FIG. 2 is a side view of the arrangement of FIG. 1.

Referring first to FIGS. 1 and 2 of the drawings, a water-cooled lance 10 is sprayed with dry ice (solid $CO_2$) pellets from nozzles 12 as the lance 10 is being withdrawn from a basic oxygen furnace. There are six nozzles 12 equi-angularly spaced around the lance 10 and oriented such that the dry ice pellets impinge on the lance 10 at an angle in the range of from about 30° on one side of a plane perpendicular to the longitudinal axis of the nozzle 10 to about 30° on the opposite side of the plane, although preferably in the range of from about 15° on one side of the plane to about 15° on the opposite side of the plane (as indicated in FIG. 2).

The dry ice pellets are sprayed from the nozzles 12 in a high velocity air stream, preferably supersonic, at a pressure in the range of from about 50 to about 300 psi, preferably in the range of from about 90 to about 250 psi. The nozzles 12 should preferably be at a distance from the lance 10 in the range of from about 1 to about 6 inches, more preferably in the range of from 1 to about 4 inches. In practice, the number of nozzles 12 will depend on the diameter of the lance. The lance 10 should be blasted while it is at an elevated temperature, preferably above about 250° F.

Figures 3, 4:
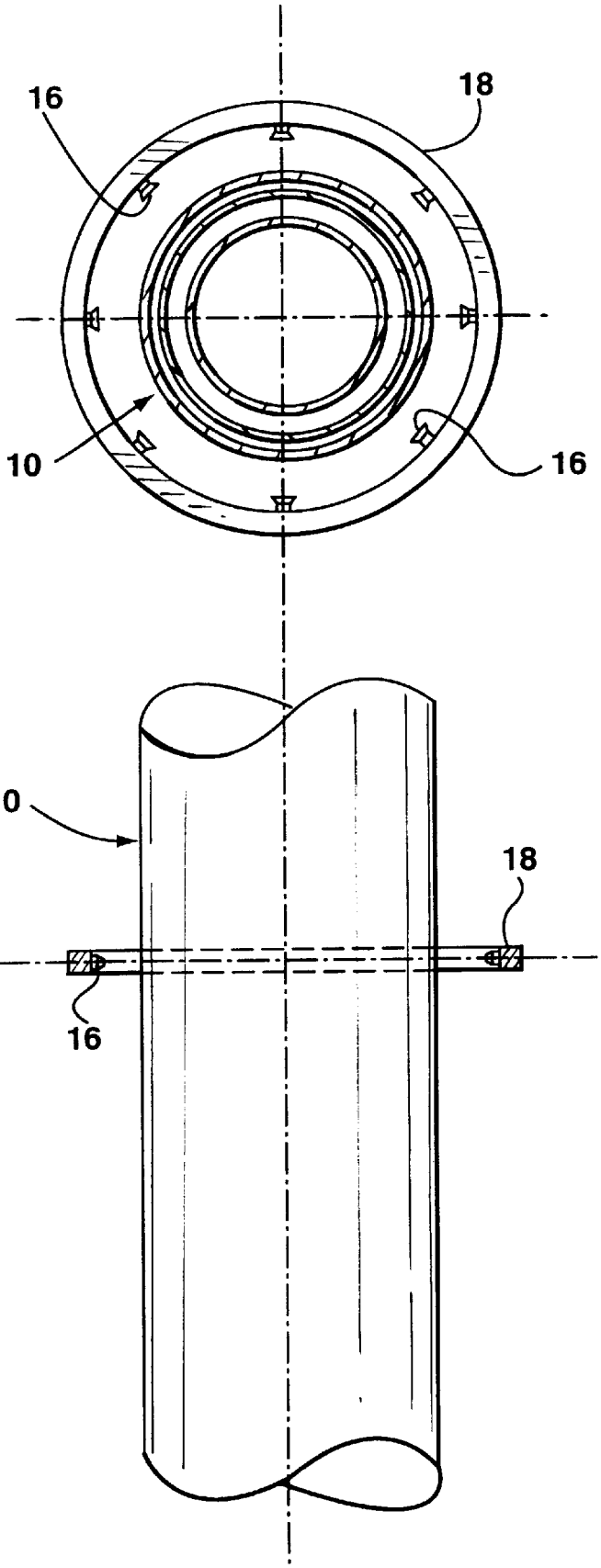
FIG. 3 is a diagrammatic plan view of an arrangement for spraying a refractory or ceramic coating onto the lance in accordance with another embodiment.
FIG. 4 is a side view of the arrangement of FIG. 3.

Referring now to FIGS. 3 and 4, the lance 10 is sprayed with a refractory or ceramic coating as it is being lowered into the furnace to minimize subsequent buildup, the coating being sprayed onto the lance 10 from nozzles 16 carried by a coating supply ring 18 extending around the lance 10. It will be noted that the nozzle 16 and supply ring 18 are also shown in FIG. 2. The refractory or ceramic coating should be of the kind which will withstand temperatures of the order of 3000° F., and the coating system should be regularly cleaned, i.e. the nozzles 10, supply ring 18 and associated piping (not shown) should be routinely purged by passing a cleaning solution such as water or a suitable solvent therethrough. As shown, the nozzles 16 are positioned in an annular configuration, the number of nozzles being dependent on the diameter of the lance.

In use, the lance 10 is blasted with $CO_2$ pellets as it is being raised from the furnace, and is coated with a refractory or ceramic coating as it is being lowered into the furnace. The $CO_2$ pellet blasting and the application of the coating may be effected as often as necessary, and may be effected each time the lance 10 is raised and lowered from and into the furnace. The lance 10 should of course be coated prior to the first use. Suitable coatings are DAG 193 or DAG 395, manufactured by Acheson Colloids Company of Port Huron, Mich., U.S.A., which are normally used as permanent mold coatings and act as a releast agent.

Since the lance 10 will still be glowing red as it is being withdrawn from the furnace, the chilling action of the dry ice along with the rapid increase in gas volume generated causes the slag and/or steel build-up on the lance 10 to crack and fall back into the furnace.

Other embodiments of the invention will be readily apparent to a person skilled in the art. For example, the invention may be used with an electric arc furnace. Also, the lance may move vertically, horizontally or at any other required angle into and out of the furnace concerned. Further, there are other ways of blasting the $CO_2$ pellets onto the lance, for example by means of a centrifugal pellet blaster. The scope of the invention is defined in the appended claims.

I claim:

1. A method of removing slag and/or steel build-up from lances in steel making furnaces including blasting dry ice pellets on to a hot lance as it is being drawn out of a furnace.

2. A method according to claim 1 wherein the dry ice pellets are sprayed from nozzles angularly spaced around the lance.

3. A method according to claim 2 wherein the nozzles are oriented such that the dry ice pellets impinge on the lance at an angle in the range of from about 30° on one side of a plane perpendicular to a longitudinal axis of the nozzle to about 30° on an opposite side of the plane.

4. A method according to claim 3 wherein said angle is in the range of from about 15° on said one side of the plane to about 15° on said opposite side of the plane.

5. A nozzle according to claim 2 wherein the dry ice pellets are sprayed from the nozzles in a superfonic air stream.

6. A nozzle according to claim 5 wherein the dry ice pellets are sprayed from the nozzles in a high velocity air stream at a pressure in the range of from about 50 to about 300 psi.

7. A method according to claim 6 wherein the pressure is in the range of from about 90 to about 250 psi.

8. A method according to claim 2 wherein the nozzles are at a distance from the lance in the range of from about 1 to about 6 inches.

9. A method according to claim 8 wherein the distance is in the range from about 1 to about 4 inches.

10. A method according to claim 1 wherein the lance is blasted with the dry ice pellets while the lance is at a temperature above about 250° F.

11. A method according to claim 1 wherein a refractory or ceramic coating is applied to the lance while it is being inserted into the furnace.

12. A method according to claim 11 wherein the coating is sprayed onto the lance by the nozzles carried by a coating supply ring extending around the lance.

13. A method according to claim 11 wherein the coats will withstand temperatures of the order of 3000° F.

14. A method according to claim 11 including periodically cleaning the nozzles and coating supply ring by passing a cleaning solution therethrough.

* * * * *